US006636459B1

(12) United States Patent
Nagata

(10) Patent No.: US 6,636,459 B1
(45) Date of Patent: Oct. 21, 2003

(54) ELECTRONIC CLOCK AND METHOD OF CONTROLLING THE CLOCK

(75) Inventor: Yoichi Nagata, Tokorozawa (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/926,418

(22) PCT Filed: Apr. 28, 2000

(86) PCT No.: PCT/JP00/02851

§ 371 (c)(1),
(2), (4) Date: Mar. 18, 2002

(87) PCT Pub. No.: WO00/67079

PCT Pub. Date: Nov. 9, 2000

(30) Foreign Application Priority Data

Apr. 28, 1999 (JP) ..... 11-122656

(51) Int. Cl.[7] ..... G04C 3/00
(52) U.S. Cl. ..... 368/204; 368/203; 368/205
(58) Field of Search ..... 368/203–205

(56) References Cited

U.S. PATENT DOCUMENTS

| | | | | | |
|---|---|---|---|---|---|
| 3,828,278 | A | * | 8/1974 | Rees | 331/116 FE |
| 4,328,572 | A | * | 5/1982 | Kawahara | 368/204 |
| 4,428,040 | A | * | 1/1984 | Yamashiro et al. | 363/62 |
| 4,730,287 | A | * | 3/1988 | Yoshino et al. | 368/205 |
| 4,901,295 | A | * | 2/1990 | Taguezout et al. | 368/149 |
| RE35,043 | E | * | 9/1995 | Takeda | 368/205 |
| 5,835,457 | A | * | 11/1998 | Nakajima | 368/204 |
| 6,169,709 | B1 | * | 1/2001 | Schafroth | 368/203 |
| 6,459,658 | B1 | * | 10/2002 | Fujita et al. | 368/203 |

FOREIGN PATENT DOCUMENTS

| | | |
|---|---|---|
| GB | 2 017 359 | 10/1979 |
| JP | 61-077788 | 4/1986 |
| JP | 62-242882 | 10/1987 |
| JP | 4-50550 | 8/1992 |
| JP | 08-036070 | 2/1996 |
| JP | 08-298734 | 11/1996 |
| JP | 11-218587 | 8/1999 |

OTHER PUBLICATIONS

JP Utility Model Laid–Open Publication No. 63–105435 (Jul. 8, 1988) w/English abstract.
JP Utility Model Laid–Open Publication No. 3–46812 (Apr. 30, 1991) w/English abstract.

* cited by examiner

*Primary Examiner*—David Martin
*Assistant Examiner*—Michael L. Lindinger
(74) *Attorney, Agent, or Firm*—Armstrong, Westerman & Hattori, LLP

(57) ABSTRACT

An electronic timepiece is controlled such that, when an amount of the actual capacity that remains in storage means 30 thereof is found to be less than a predetermined amount as a result of measurement of a voltage between the terminals of the storage means 30 by voltage measurement means 80, all electrical discharge paths from the storage means 30 to timing means 20 and an electric power generator 10 are completely shut off by the agency of charge/discharge control means 40, thereby preventing occurrence of wasteful over-discharge from the storage means 30. As a result, upon resumption of power generation by the electric power generator 10, entire electric energy generated can be effectively utilized, so that the restart of a time-keeping operation by the timing means 20 is speeded up, and the operation thereafter is stabilized.

4 Claims, 5 Drawing Sheets

ELECTRONIC CLOCK AND METHOD OF CONTROLLING THE CLOCK

TECHNICAL FIELD

The present invention relates to an electronic timepiece (clock and watch) incorporating an electric power generator for generating electric energy by utilizing externally available energy, and storage means for storing the electric energy generated by the electric power generator, and capable of performing a time-keeping operation by use of the electric energy generated or the electric energy stored, and a method of controlling the same.

BACKGROUND TECHNOLOGY

There have lately become commercially available and been put to practical applications various types of electronic timepieces incorporating an electric power generator for converting external energy such as optical energy, mechanical energy and so forth into electric energy, and capable of driving timing means by utilizing the electric energy.

Among the electronic timepieces incorporating such an electric power generator, there are included a solar cell electronic timepiece using a solar cell for the electric power generator, a mechanical power generation type electronic timepiece for utilizing electric energy converted from mechanical energy generated by rotation of a rotary weight, a temperature difference electric power generation timepiece for generating electric power by utilizing difference in temperature between the opposite ends of a plurality of thermocouples connected in series and so forth.

The electronic timepieces incorporating any of these electric power generators have storage means as well which is incorporated therein for storing electric energy generated by an electric power generator thereof by use of the external energy when die external energy is available so as to enable the electronic timepieces to be driven continuously and stably all the time even after the external energy is gone.

Such electronic timepieces as described above come to stop performing a time-keeping operation without supply of the external energy and upon completing discharge of the electric energy stored in the storage means. However, at least after the restart of the supply of the external energy, these electronic timepieces resume the time-keeping operation.

Among the electronic timepieces incorporating various types of electric power generators as described above, a solar cell timepiece is disclosed in, for example, JP, H4-50550, B.

A power supply system of such a conventional electronic timepiece is described hereinafter with reference to FIGS. 6 and 7. FIG. 6 is a circuit diagram showing the configuration of the conventional electronic timepiece, and FIG. 7 is a circuit diagram showing the circuit configuration of a common transmission gate.

With the electronic timepiece shown in FIG. 6, electric power generator 1 is connected with storage means 3 and timing means 2 via charge/discharge control means 4.

The electric power generator 1, which is a solar cell, a diode 43, and the timing means 2 form a closed circuit. The timing means 2 is comprised of a timing block 5 for executing a time display operation by use of electric energy, and a capacitor 23 having a capacitance on the order of 10 $\mu$F, which are connected with each other in parallel.

Further, the electric power generator 1, a diode 44, second switching means 42, and the storage means 3 form another closed circuit The second switching means 42 is for use in charging the storage means 3, but description thereof is omitted herein.

A transmission gate 60, which is first switch means 41, interconnects the negative terminal of the capacitor 23 and that of the storage means 3 such that the capacitor 23 and the storage means 3 are connected in parallel.

In order to enable the timing means 2 to restart its operation by connecting the electric power generator 1 with only the timing means 2 when power generation by the electric power generator 1 is restarted after complete discharge of electric energy from the storage means 3, the transmission gate 60 is made up to be controlled so as to be in the OFF condition at the time of reactivation.

Similarly, the second switching means 42 is also made up to be controlled so as to be In the OFF condition at the time of the reactivation of the timing means 2.

That is, the operation of the timing means 2 remains suspended when the electric power generator 1 is not generating power while the storage means 3 has been discharged substantially to its fully depleted state, however, upon the restart of power generation by the electric power generator 1, electric energy generated is delivered only to the timing means 2.

However, as shown in FIG. 7, the transmission gate 60 normally has a configuration of two transistors connected in parallel, that is, the configuration wherein the source terminal (S) and the drain terminal (D) of a transistor 61, and those of a transistor 62 have connections in common, respectively. In this case, for both the transistors 61, 62, a MOS field effect transistor (hereinafter referred to as "MOSFET") is used.

Further, in a normal configuration, a P-channel MOSFET is used for the transistor 61 and an N-channel MOSFET is used for the transistor 62.

Because controlling of on/off of the transistor 61 as well as the transistor 62 requires an inverting signal respectively, there is a need for providing an internal inverter 63.

The internal inverter 63, and the transistors 61, 62 come into operation by a switching control signal S4 outputted from the timing block 5 inside the timing means 2. The switching control signal S4 is a signal which will be at the level of a potential of the negative terminal VSS1 of the timing means 2 when a voltage between the terminals of the capacitor 23 is at a predetermined value or higher, and will be at the ground potential level when the voltage is lower than the predetermined value.

For turning off the transmission gate 60, it is necessary to render a potential of the gate terminal of the transistor 62 identical to that of the source terminal thereof, and further, to render a potential of the gate terminal of the transistor 61 identical to the ground potential by the agency of the internal inverter 63. However, even if such control as described can be effected, the transistors 61, 62 have a PN junction formed therein respectively, and particularly, in the transistor 62, there is formed a diode wherein current flows in the direction of the arrow Q from the source terminal (S) to the drain terminal (D).

Accordingly, the transistor 62 has a circuit configuration wherein even if the transistor 62 is in the off condition, its circuit is not completely cut off so that electric energy stored in the storage means 3 is dischargeable towards the timing means 2 all the time.

Thereupon, an oscillation circuit, and other control circuits within the timing block 5 of the timing means 2 are not completely turned off, and wasteful leakage current continues to flow for many hours, thereby resulting in progress in the discharge from the storage means 3.

As a result, there have arisen problems in that, once the electronic timepiece described in the foregoing is kept out of use for many hours, even if power generation is rested, time ranging from several tens of minutes to several hours from the restart of power generation is required for recharging up to a level enabling the tiring means 2 to continue its operation, and if power generation by the electric power generator 1 comes to a stop during a period of the recharging, the timing means 2 stops its operation immediately, In other words, even if power generation is restarted by the electric power generator 1, electric energy generated by the electric power generator 1 is used simply for charging the storage means 3 during a period of recharging the storage means 3 to replenish a portion of the electric energy stored in the storage means 3 over-discharged due to leakage current as described above, thereby preventing the electric energy generated to be directly utilized as energy used for performing the time-keeping operation by the timing means 2, Consequently, the restart of the time-keeping operation is delayed, posing a major problem with the initial startup operation characteristics of the electronic timepiece incorporating the electric power generator.

The invention has been developed to overcome the above-described problems, and it is therefore an object of the invention to provide an electronic timepiece incorporating an electric power generator, wherein occurrence of over-discharge from storage means, more than inevitable, is prevented even wit the elapse of many hours after suspension of power generation by the electric power generator, so that the time-keeping operation can be started immediately upon the restart of power generation by the electric power generator.

DISCLOSURE OF THE INVENTION

To this end, the invention provides an electronic timepiece having the following configuration, and a method of controlling the same.

The electronic timepiece according to the invention comprises an electric power generator for converting external energy into electric energy, a storage means for storing tie electric energy generated by the electric power generator, a timing means for performing a time-keeping operation by use of the electric energy supplied from the storage means or the electric power generator, and a charge/discharge control means for executing transfer or shutoff of the electric energy among the electric power generator, the storage means, and the timing means, wherein a voltage measurement means for measuring a voltage between the terminals of the storage means is included, and the charge/discharge control moans is provided with a means for completely shutting off a discharge path of the storage means when an amount of the actual capacity that remains in the storage means is less than a predetermined amount according to the voltage between the terminals of the storage means as measured by the voltage measurement means.

The electronic timepiece wit these features preferably further comprises a timing stoppage detection means for detecting stoppage of the time-keeping operation in the timing means, and a means for maintaining a condition in which the discharge path is completely shut off by the agency of the charge/discharge control means by nullifying either a voltage measuring operation or measurement results of the voltage measurement means during a period from the complete shutoff of the discharge path of the storage means by the charge/discharge control means to a time when the stoppage of the time-keeping operation in the timing means is detected by the timing stoppage detection means, The invention also provides the method of controlling the electronic timepiece as described above, wherein the electronic timepiece is controlled such that an amount of the actual capacity that remains in the storage means does not go far below a predetermined amount by completely shutting off a discharge path of the storage means at least when the amount of the actual capacity that remains in the storage means is less than the predetermined amount.

In the method of controlling the electronic timepiece with these features, information on the amount of the actual capacity that remains in the storage means may be obtained by measuring the voltage between the terminals of the storage means, In the method of controlling the electronic timepiece with all those features, during a period from the complete cutoff of the discharge path of the storage means to at least a time when the time-keeping operation by the timing means is once stopped, a completely shut off condition of the discharge path is preferably maintained regardless of measurement results on the voltage between the terminals of the storage means.

Furthermore, when the amount of the actual capacity that remains in the storage means is less than the predetermined amount and the electric energy generated by the electric power generator exceeds a predetermined amount, the electronic timepiece is preferably controlled such that the electric energy generated by the electric power generator is preferentially delivered to the timing means.

Or when the amount of the actual capacity that remains in the storage means is less than the predetermined amount and the electric energy generated by the electric power generator exceeds the predetermined amount, the electronic timepiece may be controlled such that the electric energy generated by the electric power generator is delivered to the timing means and the storage means.

Hence, according to the invention, it is possible to prevent the occurrence of over-discharge of the storage means, which used to pose a problem in the past, so that the restart of the electronic timepiece can be effected with certainty even after the operation of the electronic timepiece is interrupted, and in addition, once the electronic timepiece restarts its operation, all portions of electric energy with which the storage means are charged by then can be utilized for the time-keeping operation even if power generation comes to a stop thereafter. Thus, the electronic timepiece capable of performing stable operation can be implemented.

BEST MODE FOR CARRYING OUT THE INVENTION

Preferred embodiments of an electronic timepiece and a method of controlling the same, according to the invention, will be described in detail hereinafter with reference to the accompanying drawings.

Figure 1:
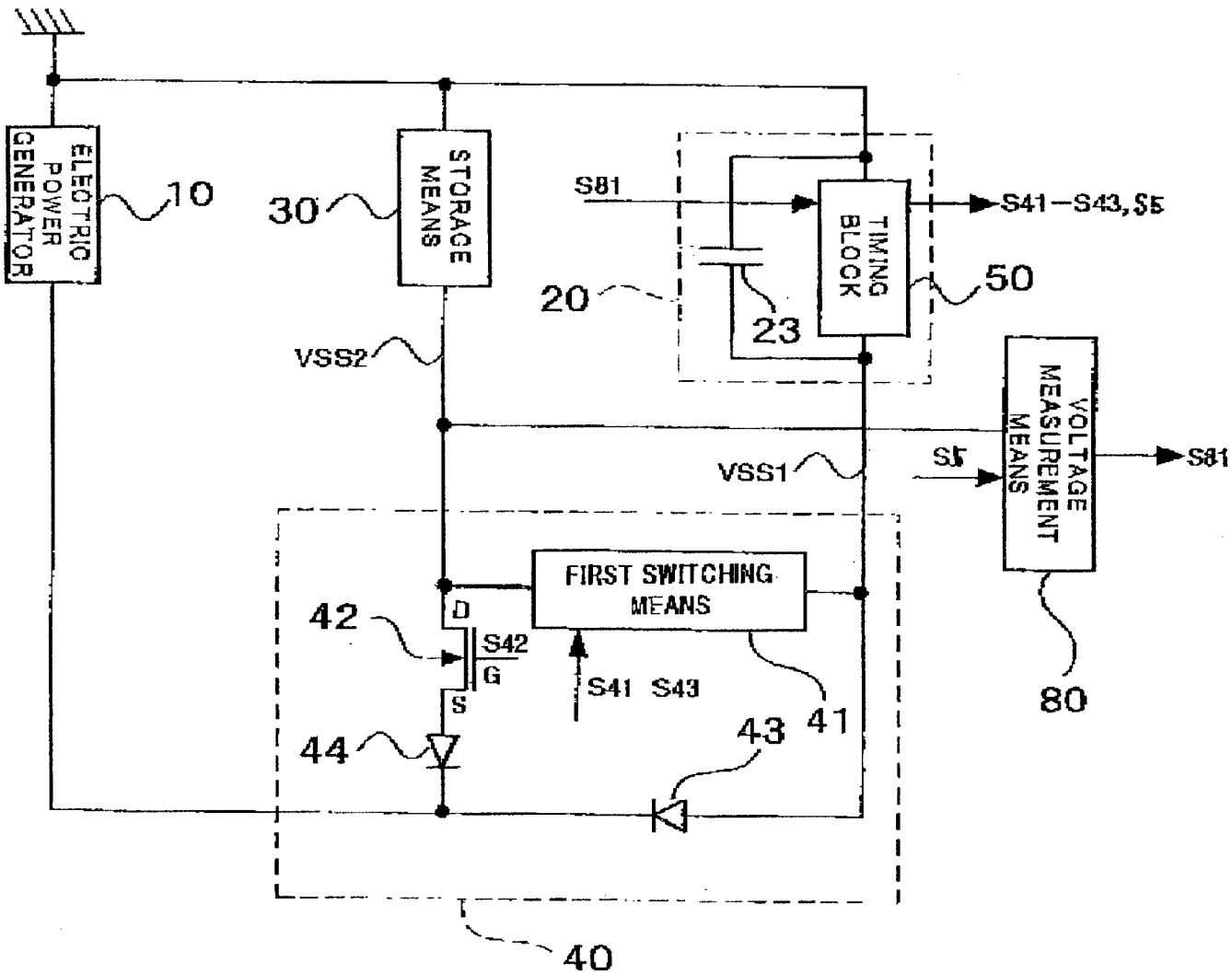
FIG. 1 is a block circuit diagram showing the configuration of an embodiment of an electronic timepiece according to the invention.

General Configuration of an Electronic Timepiece: FIG. 1

Figure 6:
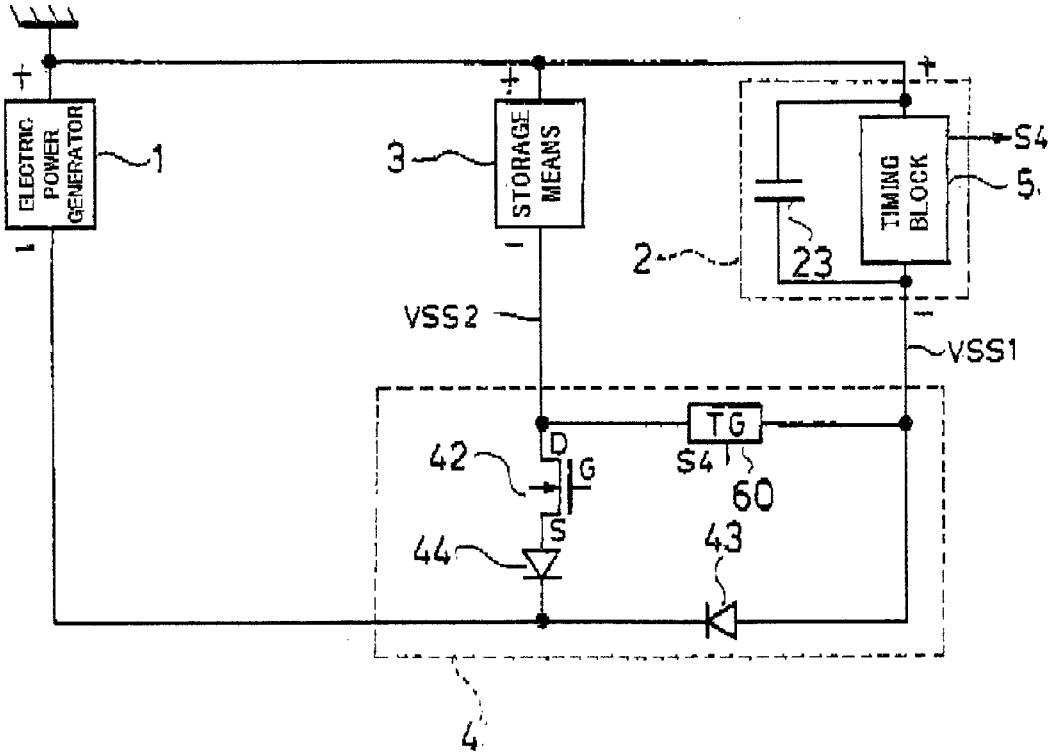
FIG. 6 PRIOR ART
FIG. 6 is a block circuit diagram showing the configuration of a conventional electronic timepiece.
Figure 7:
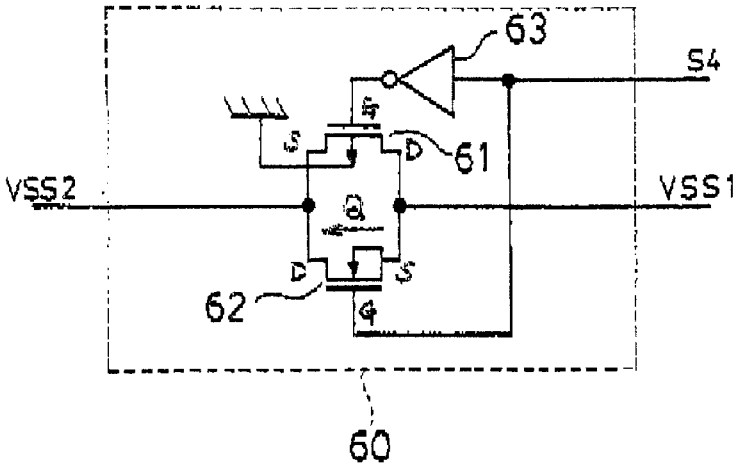
FIG. 7 PRIOR ART
FIG. 7 is a circuit diagram showing the configuration of a common transmission gate for use as first-switching means in FIG. 6.

First, the configuration of an embodiment of an electronic timepiece according to the invention is described with reference to FIGS. 1 to 3. FIG. 1 is a block circuit diagram showing the general configuration of the electronic timepiece, and in the figure, parts corresponding to those of the conventional example shown in FIG. 6 are denoted by like reference numerals.

An electric power generator 10 according to this embodiment of the invention is a thermoelectric power generator (thermoelectric device block) for converting externally present thermal energy into electric energy. That is, the electronic timepiece according to this embodiment is assumed to be an electronic timepiece comprising the thermoelectric power generator for generating electric power by utilizing difference in temperature as an energy supply source.

Further, although not shown in the figure, the thermoelectric power generator according to this embodiment of the invention is constructed such that a thermoelectric device comprised of a plurality of thermocouples connected in series is disposed in such a way as to cause the hot contact point side thereof to come in contact with the case back cover of the electronic timepiece, and the cold contact point side thereof to come in contact with the case of the electronic timepiece, which is thermally insulated from the case back cover, so that the electronic timepiece is driven by electric energy generated by the difference in temperature, occurring between the case and the case back cover when the electronic timepiece is being carried by a user.

In this case, the electric power generator 10 is assumed to be able to obtain a thermoelectromotive force (voltage) of about 2.0 V for every 1° C. of the difference in temperature.

Diodes 43, 44 serve as switching elements for preventing reverse flow of electric energy scored in storage means 30 as described later towards the electric power generator 10.

That is, both the cathode of the diode 43 and that of the diode 44 are connected to the negative terminal of the electric power generator 10.

The anode of the diode 43 is connected to the negative terminal of timing means 20 as described later. The diode 44 is connected to the storage means 30 via second-switching means 42 such that the storage means 30 and the electric power generator 10 form a closed circuit.

That is, the drain terminal (D) of the second switching means 42 composed of a MOSFET is connected to the negative terminal of the storage means 30, and the source terminal (S) of the second switching means 42 is connected to the anode of the diode 44.

The storage means 30 is a lithium ion secondary cell, and is provided in order to store electric energy generated by the electric power generator 10 so as to enable the timing means 20 to be operational even when no electric power is being generated by the electric power generator 10. The respective positive terminlas of the storage means 30, the electric power generator 10, and the timing means 20 are grounded.

First switching means 41 is provided so that the storage means 30 and the timing means 20 are connected in parallel. That is, the first switching means 41 has one terminal thereof, connected to the negative terminal of the timing means 20, and the other terminal thereof, connected to the negative terminal of the storage means 30.

The first switching means 41 is also composed of a group of MOSFETs, and serves as a switching circuit for executing charging/discharging of the storage means 30 together wilt the second switching means 42. The specific configuration of the first switching means 41 will be described later.

With this embodiment, the diodes 43, 44, the first switching means 41, and the second switching means 42 make up charge/discharge control means 40.

Meanwhile, tho timing means 20 is comprised of a timing block 50 for executing tie display by use of electric energy, and a capacitor 23 having a capacitance on the order of 22 $\mu$F, which are connected in parallel. The configuration of the timing block 50 inside the timing means 20 will be also described in detail later.

A first switch signal S41, a second switch signal S42, and a third switch signal S43 are outputted from the timing block 50 making up the timing means 20, and the second switch signal S42 controls the second switching means 42 while the first switch signal S41 and the third switch signal S43 control the first switching means 41.

Further, as with the case of a common type electronic timepiece, a complementary MOS (CMOS) field effect integrated circuit is used in a control circuit part of the timing means 20 although not shown in the figure.

The respective positive terminals of the electric power generator 10 and the timing means 20 are grounded, and a closed circuits is formed by the electric power generator 10, the diode 43, and the timing means 20.

For the sake of convenience in description to be given hereinafter, the negative terminal of the timing means 20 is referred to as VSS1 while the negative terminal of the storage means 30 is referred to as VSS2.

Further, voltage measurement means 80 is connected to the negative terminal of the storage means 30 in order to detect whether or not voltage between the terminals of the storage means 30 exceeds a predetermined value. The measurement output of the voltage measurement means 80, in the form of a measurement result signal S81, is sent out to the timing means 20.

Also, a measurement signal S5 from the timing block 50 for providing a measuring timing inputted to the voltage measurement means 80. As with the control circuit part of the timing means 20, the voltage measurement means 80 also is made up of a CMOS circuit, and the specific configuration thereof will be described later.

First Switching Means: FIGS. 2 and 3

The specific configuration of the first switching means 41 in FIG. 1 is described hereinafter with reference to FIGS, 2 and 3.

Figure 2:
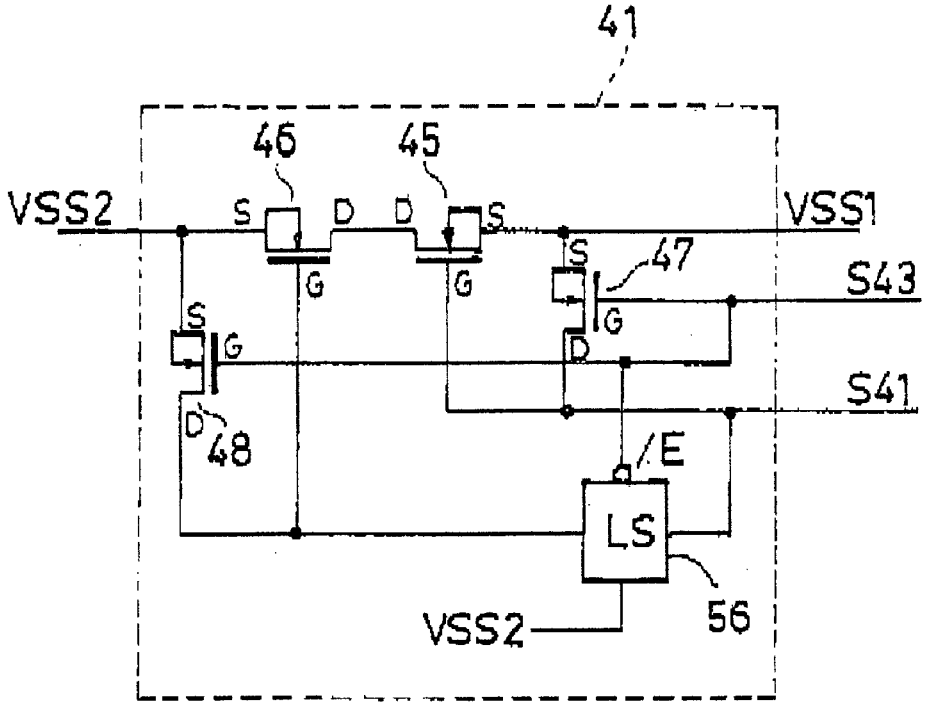
FIG. 2 is a circuit diagram showing a specific example of first switching means in FIG. 1.

As shown in FIG. 2, the first switching means 41 is comprised of a first transistor 45, a second transistor 46, a third transistor 47, a fourth transistor 48, and a level shifter 56. Any of the first to fourth transistors 45 to 48 is a N-channel MOSFET.

Particularly, for the first transistor 45 and the second transistor 46, a N-channel MOSFET having a sufficiently wide channel width and a low on-resistance is employed.

The first transistor 45 and the second transistor 46 have respective drain terminals (D) connected to each other, and the first transistor 45 has the source terminal (S) connected to the negative terminal VSS1 of the timing means 20 while the second transistor 46 has the source terminal (S) connected to the negative terminal VSS2 of the storage means 30.

The first switch signal S41 is inputted to the gate terminal (G) of the first transistor 45.

The level shifter 56 is a level shifter for converting a logical signal level at a potential of the ground potential and the potential of VSS1 to that at a potential of the ground potential and the potential of VSS2.

The level shifter 56 has a negative logic enable input terminal /E to which the third switch signal S43 is inputted, outputting its level conversion output to the gate terminal of the second transistor 46.

The third transistor 47 and the fourth transistor 48 are transistors used for pulling down, operating so as to turn off both the first transistor 45 and the second transistor 46 while the third switch signal S43 stays at the high level, that is, at the ground level, More specifically, the third transistor 47 has the drain terminal (D) connected to the gate terminal (C) of the first transistor 45, and the source terminal (S) connected to VSS1, respectively.

Further, the fourth transistor 48 has the drain terminal (D) connected to the gate terminal (G) of the second transistor 46, and the source terminal (S) connected to VSS2, respectively.

The third switch signal S43 is inputted to both the gate terminal (G) of the third transistor 47 and the gate terminal (G) of the fourth transistor 48.

Figure 3:
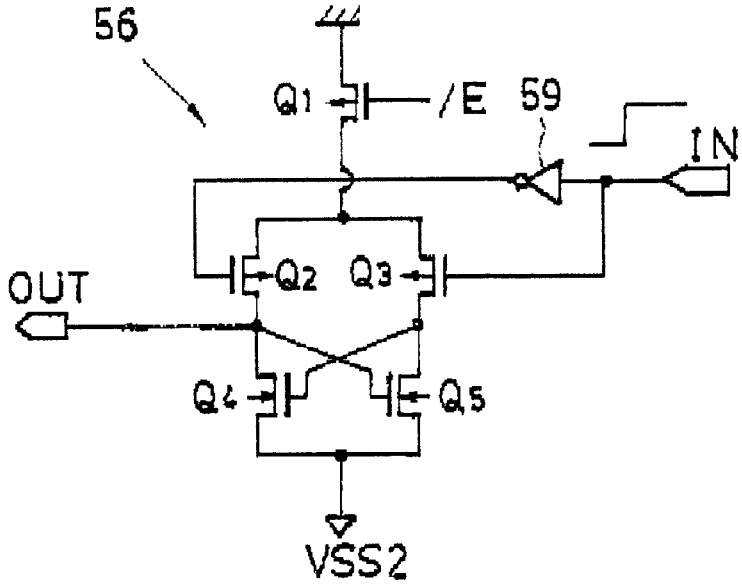
FIG. 3 is a circuit diagram showing a specific example of a level shifter 56 in FIG. 2.

FIG. 3 is a circuit diagram showing the configuration of the level shifter 56 by way of example. With the level shifter 56, transistors Q1, Q2 and Q3 made up of a P-channel MOSFET are connected to transistors Q4 and Q5 made up of a N-channel MOSFET, respectively, between the earth and VSS2, as shown in the figure. The third switch signal S43 is inputted to the gate terminal of the transistor Q1, and an input terminal IN is connected directly to the gate terminal of the transistor Q3, and to the gate terminal of the transistor Q2 via an inverter 59, respectively.

The inverter 59 Is an inverter for outputting logical signals at potentials of the ground potential and the potential of VSS1.

Further, a node between the transistor Q2 and the transistor Q4 is connected to an output terminal OUT as well as the gate terminal of the transistor Q5 while a node between the transistor Q3 and the transistor Q5 is connected to the gate terminal of the transistor Q4.

The gate terminal of the transistor Q1 serves as the negative logic enable input terminal /E, to which the third switch signal S43 is inputted.

The level shifter 56 is a type of device wherein the output thereof becomes open when the negative logic enable input terminal /E is at a high level, and the input terminal IN is completely isolated from the output terminal OUT.

Figure 4:
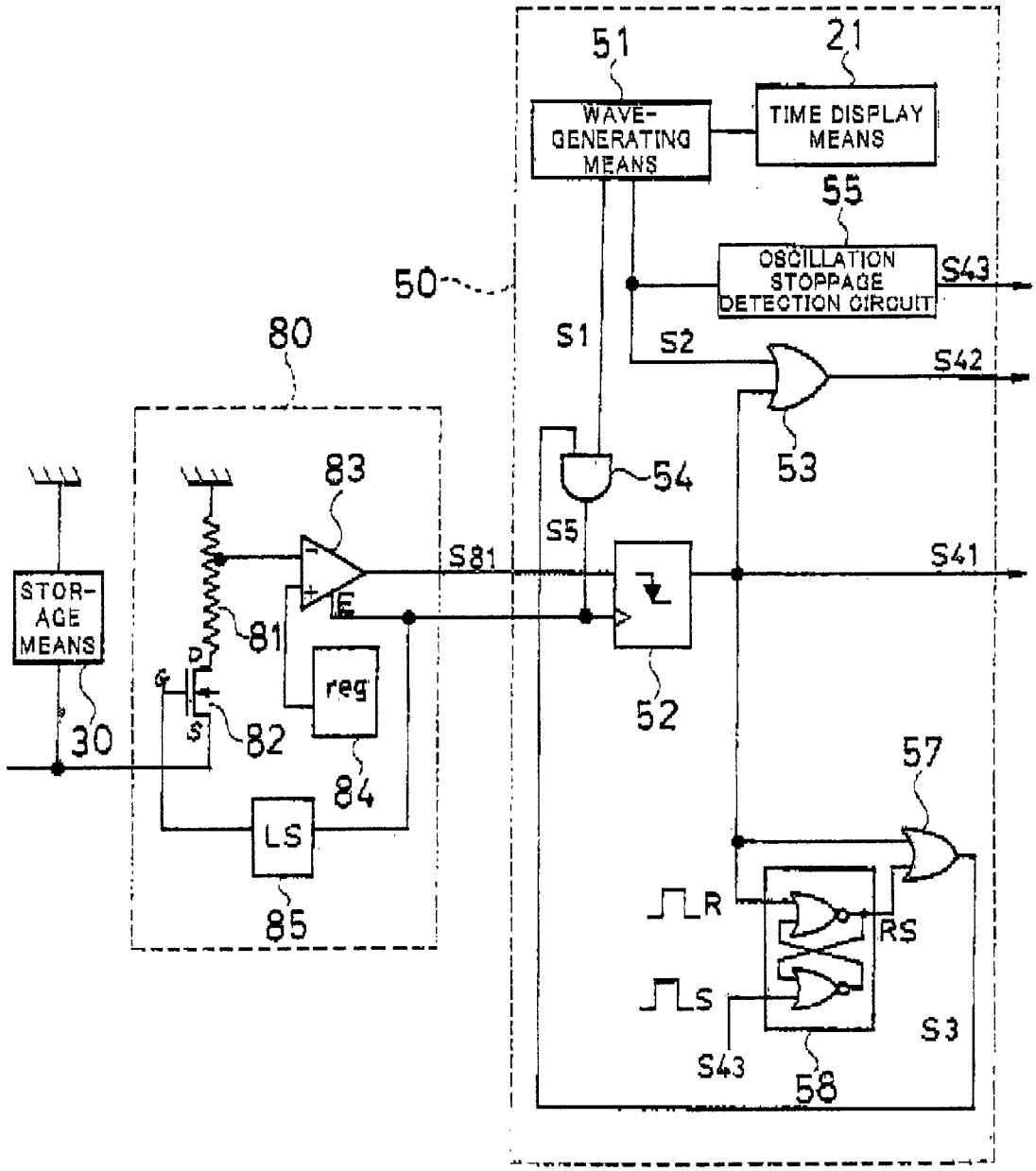
FIG. 4 is a circuit diagram showing the configuration of a timing block and voltage measurement means in FIG. 1.

Timing Block and Voltage Measurement Means: FIG. 4

Referring to FIG. 4, the specific configurations of the timing block 50 of the timing means 20, and the voltage measurement means 80, as shown in FIG. 1, are hereinafter described by way of example.

As described previously, the timing means 20 is comprised of tie timing block 50 and the capacitor 23. As shown in FIG. 4, the timing block 50 is comprised of time display means 21, wave-generating means 51, a data latch 52, OR gates 53, 57, an oscillation stoppage detection circuit 55, and an RS flip-flop circuit 58. The time display means 21 is comprised of a stepping motor (not shown), a reduction gear train, time display hands, a dial and so on, being a part of the timing block 50, for performing time display by transferring rotation of the stepping motor after reduction of rotation speed by the agency of the reduction gear train and thereby rotating the time display hands.

As with the case of the common type electronic timepiece, the wave-generating means 51 is a part of the timing block 50, for dividing the frequency of oscillation generated by a crystal oscillator into a frequency having an oscillating period of at least 2 seconds, and transforming a signal of such a divided frequency into a waveform necessary for driving the stepping motor incorporated in the time display means 21.

Since the wave-generating means 51 and the tm display means 21 are the same elements as those for die common type electronic timepiece, detailed description thereof is omitted.

The voltage measurement means 80 is comprised of a dividing resistor 81, a divider switch 82, a comparator 83, a constant voltage circuit 84, and a level shifter 85.

The wave-generating means 51 of the timing block 50 outputs the measurement signal Si and a distribution signal S2. The measurement signal S1 is in a waveform having a period of 2 seconds, rising to a high level in 90 $\mu$s.

Further, the distribution signal S2 is a signal in the form of a 2 Hz rectangular wave, providing timing to serve as a basis on which the electric energy generated by the electric power generator 10 is distributed between the storage means 30 and the capacitor 23.

The distribution signal S2 doubles as a signal used for detecting whether or not the wave-generating means 51 is operated by the oscillation stoppage detection circuit 55 as described in detail later.

Since generation of such waves as described can be effected by a simple synthesis of waveforms, description of a wave-generating method is omitted.

The comparator 83 of the voltage measurement means 80 is a common type comparator capable of comparing magnitude of a reference voltage which is the output voltage of the constant voltage circuit 84 with that of an input voltage as divided by the dividing resistor 81.

The constant voltage circuit 84 is a regulator circuit for use in obtaining the reference voltage at a constant level from a power supply source at a varying voltage. In this case, the constant voltage circuit 84 is assumed to output the reference voltage at −0.8V, and energy for driving the constant voltage circuit 84 is supplied from the capacitor 23 of the timing means 20, shown in FIG. 1.

The dividing resistor 81 is a high-precision high-resistance element, and one end of the dividing resistor 81 is connected to the drain terminal (D) of the divider switch 82 while the other end of the dividing resistor 81 is grounded.

The source terminal (S) of the divider switch 82 is connected to the negative terminal of the storage means 30, namely, VSS2, In this case, the dividing resistor 81 has a resistance value of 500 KΩ.

The output of the level shifter 85 is applied to the gate terminal (G) of the divider switch 82. The level shifter 85 is installed in order to convert the logic level of the measurement signal S1 to a potential of the ground potential and VSS2.

The comparator 83 has the noninverting input terminal to which the reference voltage from the constant voltage circuit 84 is inputted. Further, the comparator 83 also has the inverting input terminal to which a divided voltage at a midpoint of the dividing resistor Si is inputted. The midpoint is located at a point having a resistance value (400 KΩ) equivalent to ⅘ of the resistance value of the first dividing resistor 81, as seen from the ground side.

With such a configuration as described above, upon taming on the divider switch 82, current flows through the dividing resistor 81, and a divided voltage, equivalent to 4/5 of a voltage at the negative terminal VSS2 of the storage means 30, is inputted to the comparator 83. If the divided voltage is lower than (or greater than in absolute value) −0.8 V which is the reference voltage supplied from the constant voltage circuit 84, the comparator 83 causes an output signal S81 to rise to a high level, while causing the output signal S81 to fall to a low level if the divided voltage is higher than (or smaller than in absolute value) −0.8 V. The output signal S81 is a signal indicating the measurement result of the voltage between the terminals of the storage means 30.

That is, if the voltage between the terminals of die storage means 30 is lower than 1.0V, the divided voltage by the dividing resistor 81 becomes not lower than −0.8V, so that the output of the comparator 83 turns to the low level.

Further, the comparator 83 has an enable terminal (E), to which is inputted an output signal S5 of an AND gate 54 implementing the logical operation AND between the measurement signal S1 and a measurement enabling signal S3 which is the output signal of an OR gate 57, That is, the comparator 83 is designed to be activated only when the measurement signal S1 rises to the high level during a period when the measurement enabling signal S3 is at the high level.

Further, during a period when the comparator 83 is not activated, that is, the enable terminal (E) is at the low level, the output of the comparator 83 is caused to forcefully rise to the high level, in other words, to be pulled up to the ground potential.

The output signal S81 of the comparator 83 becomes a data input of a data latch 52. The output signal S81 of the comparator 83 is hereinafter referred to as a measurement result signal.

The data latch 52 is a data latch circuit which resets the output thereof when the power supply source is turned on.

The data latch 52 has a latch terminal to which the output signal S5 (identical to the measurement signal Si during a period when the measurement enabling signal S3, that is, the output signal of the OR gate 57, is at the high level) of the AND gate 54 is inputted, holding and outputting the logic of a signal of the data input, namely, the measurement result signal S81, at the falling edge of a waveform of the measurement signal S1.

The output of the data latch 52 is sent out as the first switch signal S41 to the first switching means 41 of the charge/discharge control means 40.

Further, an OR gate 53 having dual inputs outputs OR between the output of the data latch 52 and the distribution signal S2 received from the wave-generating means 51. The output of the OR gate 53 is sent out as the second switch signal S42 to the second switching means 42 of the charge/discharge control means 40.

The first switch signal S41 which is the output of the data latch 52 is also inputted to the reset terminal R of the RS flip-flop circuit 58, and at the rising edge thereof resets the RS flip-flop circuit 58, causing the RS output thereof to fall to the low level, but during a period when the first switching signal S41 is at the high level, the measurement enabling signal S3, that is, the output signal of the OR gate 57, is kept at the high level. However, since the measurement result signal S81 is turned to the low level, and the output signal S5 of the AND gate 54 remains at the low level, upon the first switch signal S41 which is the output of the data latch 52 turning to the low level, the measurement enabling signal S3 which is the output signal of the OR gate 57 is also turned to the low level, thereby causing the comparator 83 to be deactivated, and preventing the data latch 52 from performing a latching operation. Thus, the first switch signal S41 keeps in a low level condition.

Further, with this embodiment of the invention, there is provided the oscillation stoppage detection circuit 55 for delivering an output at the low level upon receiving a clock input at a frequency of a predetermined frequency (in this case, 2 Hz) or more, and otherwise, delivering an output at the high level.

The oscillation stoppage detection circuit 55 functions as timing stoppage detection means, and receives the distribution signal S2 from the wave-generating means 51, detecting oscillation stoppage by turning the output thereof to the high level when the distribution signal S2 is no longer inputted thereto while keeping the output at the low level when the distribution signal S2 is being inputted. The output signal of the oscillation stoppage detection circuit 55 is sent out as the third switch signal S43 to the first switching means 41 of the charge/discharge control means 40.

The third switch signal S43 is inputted also to the set terminal S of the RS flip-flop circuit 58 of the timing block 50, and upon detection of the oscillation stoppage, sets the RS flip-flop circuit 58, thereby turning the RS output thereof to the high level, whereupon the measurement enabling signal S3, that is, the output signal of the OR gate 57, is turned to the high level.

Accordingly, from this point in time and onwards, the output signal S5 of the AND gate 54 becomes identical to the measurement signal S1, and the comparator 83 is enabled to perform its measuring operation if the measurement signal S1 is outputted, thereby latching data of the measurement result signal S81 which is the output of the comparator 83, so that the data is outputted as the first switch signal S41.

Since the oscillation stoppage detection circuit 55 is a circuit as commonly used, detailed description of the configuration thereof is omitted.

Such respective control circuits as described above are made up so as to be operated by the electric energy stored in the capacitor 23 of the timing means 20 shown in FIG. 1, and the respective logic signal levels of the first to third switch signals S41 to S43 and the measurement result signal S81 are at the ground potential and the potential of VSS1.

Description of Operation of the Electronic Timepiece: FIGS. 1 to 4, and 5

Figure 5:
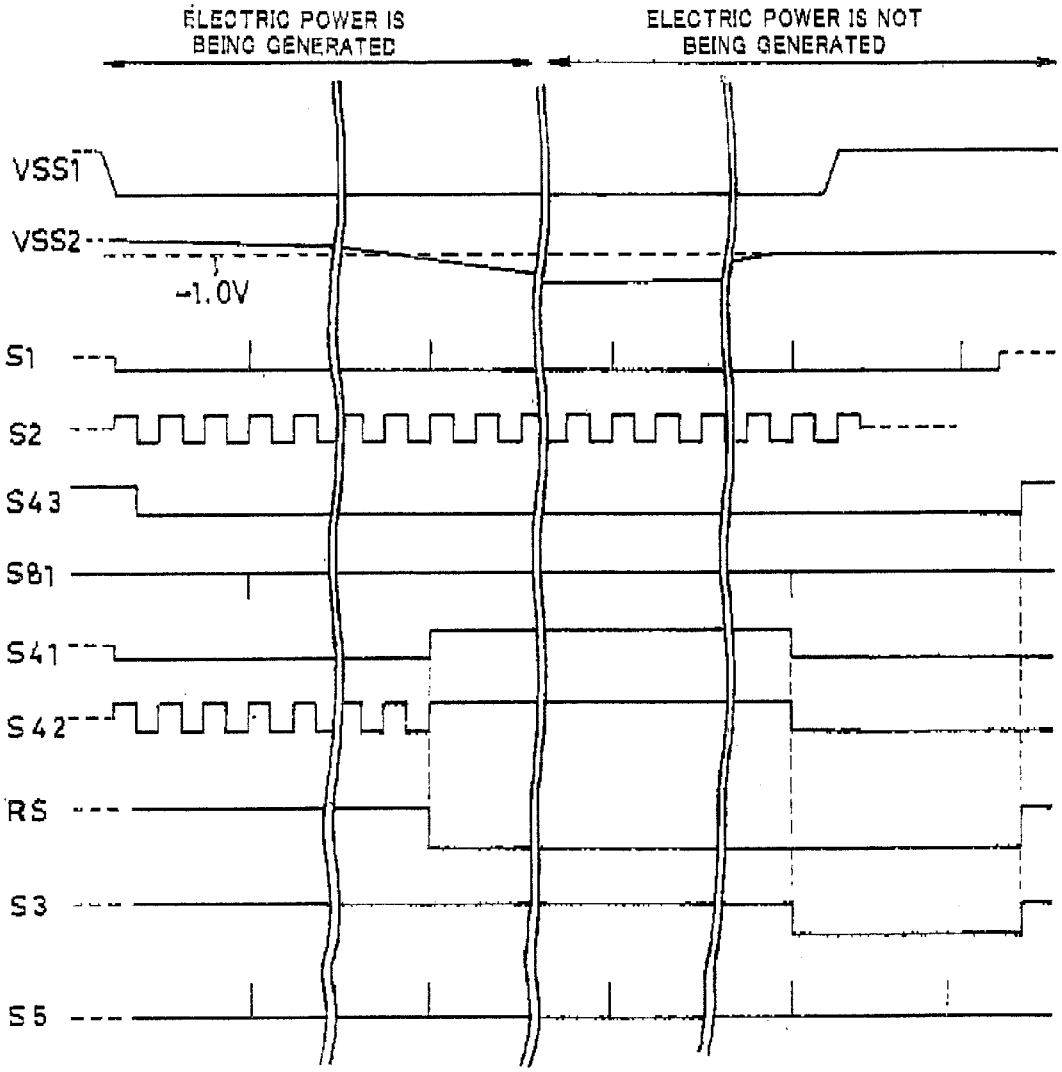
FIG. 5 is a waveform chart showing voltage waveforms at principal parts of the embodiment of the electronic timepiece according to the invention shown in FIG. 1.

Next, the operation of the electronic timepiece according to the above-described embodiment is described hereinafter with reference to FIGS. 1 to 4, and 5. FIG. 5 additionally referred to is a waveform chart showing voltages at principal circuit parts of the electronic timepiece. In FIG. 5, VSS1 denotes a voltage at the negative terminal of the timing means 20, and VSS2 denotes a voltage at the negative terminal of the storage means 30.

First, the operation of the electronic timepiece at the time of start-up is described hereinafter.

It is assumed in this case that the storage means 30 in a hardly charged state is assembled in the electronic timepiece, and a storage voltage of the storage means 30 is on the order of 0.6V.

In FIG. 1, upon start of power generation by the electric power generator 10, the electric energy generated by the electric power generator 10 is at first stored in the capacitor 23 via the first diode 43, In the case where the electronic timepiece is a wrist watch, power generation is started due to the difference in temperature, occur,g to the electric power generator 10 which is a thermoelectric power generator, when, for example, a user carries the wrist watch worn on the wrist of the user.

If the wave-generating means 51 inside the timing means 20 is not in operation as yet at this point in time, the oscillation stoppage detection circuit 55 is outputting a signal at the high level and consequently, both die third transistor 47 and the fourth transistor 48 of the first switching means 41 inside the charge/discharge control means 40, as shown in FIG. 2, are in the ON condition.

Thereupon, a potential at the gate of the first transistor 45 inside the first switching means 41 becomes equivalent to a potential at VSS1 while a potential at the gate of the second transistor 46 becomes equivalent to a potential at VSS2. As a result, both the first transistor 45 and the second transistor 46 are forcefully turned off.

In this condition, no current flows either in a direction from VSS1 to VSS2 or in a direction from VSS2 to VSS1, so that the negative terminal VSS1 of the timing means 20 is completely cut off from the negative terminal VSS2 of the storage means 30 so as to be in a condition isolated from each other.

Further, because output of the data latch 52 in FIG. 4 reset when the power supply source of the timing means 20 is turned on, tee first switch signal S41 is turned to the low level, and the second switch signal S42 as well is turned to the low level.

Thereupon, the second switching means 42 in FIG. 1 is turned off, and the electric energy generated by the electric power generator 10 is delivered only to the timing means 20, so that rapid charging of the capacitor 23 is executed.

When the voltage between the terminals of the capacitor 23 exceeds 1.0V, the timing means 20 is enabled to start operation, thereby starting a time-keeping operation.

Thereupon, the wave-generating means 51 of the timing block 50, shown in FIG. 4, starts an operation for dividing the frequency of oscillation, and the distribution signal S2 in the form of a rectangular wave at the predetermined frequency comes to appear, whereupon the third switch signal S43 which is the output of the oscillation stoppage detection circuit 55 falls to the low level, thereby turning off the third transistor 47 and the fourth transistor 48 of the first switching means 41, shown in FIG. 2.

However, since the first switch signal S41 is at the low level at this point in time, both the first transistor 45 and the second transistor 46 remain in the off condition, so that the condition isolated from each other is maintained between VSS1 and VSS2.

Now, a voltage measuring operation and a charging operation of the electronic timepiece are described hereinafter.

If the electric power generator 10 continues power generation from the start-up and onwards, the distribution signal S2 keeps a predetermined waveform, and consequently, the second switch signal S42 repeats the high level and the low level alternately in a cycle of 250 milliseconds. As a result, the second switching means 42 in FIG. 1 repeats ON/OFF alternately, so that the electric power generator 10 is connected to the storage means 30 during a period when the second switching means 42 is in the ON condition, and only during this period, charging current is supplied from the electric power generator 10 to the storage means 30 via the second diode 44.

On the other hand, during a period when the second switch signal S42 is at the low level, charging of the storage means 30 is not performed, so that the electric energy generated by the electric power generator 10 is supplied towards the timing means 20, thereby charging the capacitor 23 with the electric energy.

The electric energy stored in the capacitor 23 is consumed by the operation of the timing block 50.

Further, as described in the foregoing, there appear micropulses rising to die high level in a cycle of 2 seconds in the measurement signal S1. Upon the measurement signal S1 rising to the high level, the divider switch 82 of the voltage measurement means 80 is turned on, during which current from the storage means 30 flows through the dividing resistor 81, whereupon a voltage equivalent to ⅘ of the voltage between the terminals of the storage means 30 occurs to the negative input terminal of the comparator 83.

In the meantime, the comparator 83 has been rendered enable so that the comparator 83 compares the reference voltage outputted by the constant voltage circuit 84 with the divided voltage supplied from the dividing resistor 81.

If the voltage between the terminals of the storage means 30 is less than 1.0 V (the amount of the actual capacity that remains in the storage means is less than a predetermined value) at his point in time, a potential closer to the ground potential than −0.8 V is inputted to the inverting input terminal of the comparator 83, and consequently, the measurement result signal S81 outputted by the comparator 83 falls to the low level.

Upon the measurement signal S1 falling to the low level with the elapse of 90 $\mu$s, the measurement result signal S81 which is at the low level is latched by the data latch 52 at such timing, and the first switch signal S41 remains at the low level.

Similarly, the second switch signal S42 keeps the same waveform as that for the distribution signal S2. It follows therefore that the first switching means 41 is in a condition for continuing the same operation as described above during a period when the voltage between the terminals of the storage means 30 is low, and sufficient charging is not being performed.

However, if the electric power generator 10 stops power generation for even a short time of several seconds during the period as described above, supply of electric energy to the timing means 20 is interrupted although this is not shown in FIG. 5, and thereby the time-keeping operation is stopped as with the case of the conventional electronic timepiece.

If the electric power generator 10 further continues power generation, charging of the storage means 30 is performed as previously described, so that the voltage between the terminals of the storage leans 30 keeps going up.

Then, when the pulses of the measurement signal S1 come to appear upon the voltage between the terminals of the storage means 30 exceeding 1.0 V (the amount of the actual capacity that remains in the storage means exceeding a predetermined value), a potential lower than (greater than in absolute value) −0.8 V is inputted to the inverting input terminal of the comparator 83, and consequently, the measurement result signal S81 rises to the high level.

Upon the measurement signal S1 falling, data at the high level is captured by the data latch 52, and the first switch signal S41 rises to the high level.

Thereafter, the second switch signal S42 as well turns to the high level all the time regardless of the distribution signal S2.

Thereupon, the second switching means 42 in FIG. 1 turns into the ON condition. In the first switching means 41, both the first transistor 45 and the second transistor 46, shown in FIG. 2, are turned on, thereby causing a conducting state to occur between VSS1 and VSS2.

As a result, the timing means 20 and the storage means 30 are connected in parallel via the first diode 43 and the second diode 44, respectively, to the electric power generator 10, Accordingly, it means that the electric energy generated by the electric power generator 10 is supplied to both the timing means 20 and the storage means 30 from this time onwards.

Thereafter, even if the electric power generator 10 stops power generation for only a very short period of time, the timing means 20 can continue the time-keeping operation as it is, because there exists a conducting state between VSS1 and VSS2 so that the electric energy stored in the storage means 30 can be supplied to the timing means 20.

Further, when the first switch signal S41 rises to the high level, the RS flip-flop circuit 58 inside the timing block 50, shown in FIG. 4, is reset, causing the RS output thereof to fall to the low level, however, because the first switch signal S41 is at the high level, the measurement enabling signal S3, that is, the output signal of the OR gate 57, remains at the high level.

Next, operation in the case where the electronic timepiece stops power generation for a long time is described hereinafter.

The operation during a period when the voltage between the terminals of the storage means 30 exceeds 1.0 V is the same as described previously in that the electric energy already stored in the storage means 30 can be fully utilized for the operation of the timing means 20.

However, if the electric power generator 10 remains out of operation for power generation for a long time, the voltage between the terminals of the storage means 30 becomes less than 1.0 V (the amount of the actual capacity that remains in the storage means becomes less tan a predetermined value) in time due to consumption of electric energy by the timing means 20.

Upon the measurement signal S1 rising to the high level, the divider switch 82 of the voltage measurement means 80, shown in FIG. 4, is turned on. and as at the time of the start-up, a potential closer to the ground potential an –0.8 V is inputted to the inverting input terminal of the comparator 83. Accordingly, the measurement result signal S81 outputted by the comparator 83 falls to the low level.

Further, upon the measurement signal S1 falling to the low level, the output of the data latch 52 turns to the low level, thereby causing the first witch signal S41 as well to fall to the low level.

Thereupon, in the first switching means 41 shown in FIG. 2, a potential at the gate of the first transistor 45 becomes equivalent to that of VSS1 while a potential at the gate of the second transistor 46 becomes equivalent to that of VSS2.

Accordingly, both the first transistor 45 and the second transistor 46 are completely turned off, so that VSS1 is completely cut off from VSS2 so as to be in a condition isolated from each other. That is, the operation of the first switching means 41 is turned off.

Then, electric energy is no longer supplied from anywhere to the capacitor 23, and when the electric energy already stored in the capacitor 23 is used up by the operation of the timing means 20 itself, the time-keeping operation of the timing means 20 comes to stop.

Upon the first switch signal S41 falling to the low level, the measurement enabling signal S3, that is, the output signal of the OR gate 57 shown in FIG. 4, falls to the low level, and the AND gate 54 no longer outputs the measurement signal Si while the output signal S5 thereof remains at the low level, so that the voltage measurement means 80 does not perform the measuring operation and the data latch 52 does not perform an operation to latch the measurement result signal S81.

Thereafter, when electric energy stored in the capacitor 23 is consumed, and the timing block 50 stops its operation, the operation of the wave-generating means 51 comes to stop, and consequently, the oscillation stoppage detection circuit 55 detects the stop, turning the third switch signal S43 to the high level (the ground potential). Accordingly, the third transistor 47 and the fourth transistor 48 shown in FIG. 2 render a potential at the respective gate terminals of the first transistor 45 and the second transistor 46 equivalent to a potential at the respective source terminals of the third transistor 47 and the fourth transistor 48, and thus the first switching means 41 is further maintained forcefully in the OFF condition.

The electronic timepiece in this state does not resume its operation unless the electric power generator 10 restarts power generation, however, as an electrical discharge path is completely cut off from the storage means 30, the voltage between the terminals of the storage means 30 does not go far below 1.0V, remaining substantially in the neighborhood of 1.0 V even thereafter. Thus, the over-discharge of the storage means 30 can be prevented with certainty.

When the electric power generator 10 restarts power generation, upon the third switch signal S43 rising to the high level, the RS flip-flop circuit 58 is set, and the RS output thereof is turned to the high level, thereby causing the measurement enabling signal S3 outputted by the OR gate 57 to rise to the high level again When the wave-generating means 51 comes to output the measurement signal S1, the measurement signal S1 is sent out via the AND gate 54 as the output signal S5, thereby causing the voltage measurement means 80 to start its measuring operation, and the data latch 52 will be in a condition wherein the measurement result signal S81 can be latched.

Accordingly, if power generation is restarted next time, and charging to the storage means 30 is performed as described above, the voltage between the terminals of the storage means 30 will immediately exceeds 1.0V, and a portion of electric energy charged thereafter to the storage means 30 can be effectively utilized for the operation of the timing means 20.

With the electronic timepiece according to this embodiment as described hereinabove, explanation is given on the case where use is made of the storage means 30 whose voltage between the terminals thereof is low at the outset, and therefore, there is a need for charging the storage means 30 so as to have a voltage at 1.0 V or higher. However, if the storage means 30 properly charged to have a capacity not less than a predetermined capacity is used, there is no need for doing so.

Further, in the case of using a secondary cell having an intrinsic property such as a chemical self-discharge effect for the storage means 30 even though no electric discharge occurs thereto, there occurs the same phenomenon as that in the case where a storage voltage is low at the outset as described in the foregoing, and hence, in such a case as well, this embodiment of the invention is preferably adopted.

As with the embodiment described above, if the circuit shown in FIG. 2 is adopted for the first switching means, this will not allow even a little charging current to flow from the electric power generator 10 to the storage means 30 because, in the first switching means 41. VSS1 is completely cut off from VSS2 due to both the first transistor 45 and the second transistor 46 being turned off when the amount of the actual capacity that remains in the storage means 30 is less than the predetermined value and the electric energy generated by the electric power generator 10 exceeds the predetermined amount.

Accordingly, the electric energy generated by the electric power generator 10 is preferentially delivered to the timing means and thereby the capacitor 23 can be rapidly charged, thus enabling the timing block 50 to speed up its restart.

However, since there are lately available a number of secondary cells having hardly any self-discharge effect, the first switching means 41 may be rendered simpler in configuration as shown below if any of such cells can be utilized for the storage means 30.

Although not shown specifically, the first switching means 41 in FIG. 2 may have a configuration wherein the first transistor 45 is removed.

With such a configuration as described above, in the case where the voltage between the terminals of the storage means 30 goes below 1.0V, the second transistor 46 of the first switching means 41 is turned off, whereupon the second transistor 46 will be in the complete cutoff condition in a direction from its drain terminal (D) to its source terminal (S), so that a discharge path from the storage means 30 to the timing means 20 is completely shut off, and occurrence of over-discharge from the storage means 30 can be prevented as with the case of the previously described embodiment.

Further thereafter, in the case where the electric power generator 10 resumes power generation at a high voltage on the order of 2.0 V, electric energy generated by the electric power generator 10 is delivered to the storage means 30 as well via the first switching means 41 and the first diode 43, however, a potential at VSS2 is −1.0 V because self-discharge does not occur to the storage means 30. At this time, the voltage between the terminals of the timing means 20 can be maintained at least at 1.0V, that is, the voltage between the terminals of the storage means 30, or higher by a voltage drop portion in the first switching means 41, thereby enabling the timing means 20 to be restarted.

However, in this case, even with the second transistor 46 in the OFF condition, since there is formed a diode forward biased in a direction from the source terminal (S) of the second transistor 46 to the drain terminal (D) of the same, when the amount of the actual capacity that remains in the storage means 30 is less than the predetermined value and the electric energy generated by the electric power generator 10 exceeds the predetermined amount, electric energy generated by the electric power generator 10 is delivered to the storage means 30 as well as the timing means 20, thereby charging both with the electric energy.

Further, as with the embodiment described hereinbefore, by adoption of the voltage measurement means, it becomes possible to optionally set a lower limit of the amount of the actual capacity remaining in the storage means 30, up to which discharging is allowed. As a result, another advantageous effect is obtained in that the necessity for designing to widen a voltage scope necessary for operation of various control circuits and other loads can be saved.

With the embodiment described hereinbefore, the thermoelectric power generator is adopted for the electric power generator 10, however, other types of power generators may be adopted.

For example, a solar cell, a mechanical type power generator, and so forth can be adopted for the electric power generator 10 without causing any problem. Further, there is no doubt that the present invention is applicable to the case where a voltage generated by the electric power generator is boosted before charging the storage means, and supplying to the timing means.

Similarly, the present invention is applicable to, for example, the case where, even when the thermoelectric power generator is adopted for the electric power generator 10, use is made of one made up of a reduced number of thermocouples, which is capable of generating a thermoelectromotive force (voltage) of about 1.0 V for every 1° C. of the difference in temperature, and a generated voltage is boosted to the extent of a reduced portion thereof by use of a booster circuit before being put to use.

INDUSTRIAL UTILIZATION

As is evident from the foregoing description, the electronic timepiece according to the invention shuts off at least the electrical discharge path from the storage means completely when the voltage between the terminals of the storage means becomes less than the predetermined value.

As a result, there will not occur over-discharge such that the amount of the actual capacity that remains in the storage means goes down far below the predetermined values, and when power generation is restarted thereafter, recharging can be performed on the basis of the amount of the actual capacity as described. Hence, there will be eliminated needs for recharging for an over-discharged portion which is wastefully lost due to the leakage of current, and has been a cause for concern in the past. Accordingly, it becomes possible to effectively utilize entire electric energy charged as electric energy for performing the time-keeping operation, so that the invention can provide an electronic timepiece capable of speeding up the startup of the time-keeping operation, particularly, at the time of restarting power generation, and having enhanced stability in operation at the outset of the charging operation.

What is claimed is:

1. An electronic timepiece comprising:

an electric power generator for converting external energy into electric energy;

a storage means for storing the electric energy generated by the electric power generator;

a timing means for performing a time-keeping operation by use of the electric energy supplied from the storage means or the electric power generator;

a charge/discharge control means for executing transfer or shutoff of the electric energy among the electric power generator, the storage means, and the timing means, wherein a timing stoppage detection means for detecting stoppage of the time-keeping operation in the timing means is included, and the charge/discharge control means comprises a discharge switch formed of a field effect transistor whose source terminal is connected to the storage means and whose drain terminal is connected to the timing means, and a means for equalizing a gate potential of the discharge switch to a source potential thereof when the stoppage of the time-keeping operation is detected by the timing stoppage detection means.

2. An electronic timepiece comprising:

an electric power generator for converting external energy into electric energy;

a storage means for storing the electric energy generated by the electric power generator;

a timing means for performing a time-keeping operation by use of the electric energy supplied from the storage means or the electric power generator;

a charge/discharge control means for executing transfer or shutoff of the electric energy among the electric power generator, the storage means, and the timing means, and a voltage measurement means for measuring a voltage between terminals of the storage means, a timing stoppage detection means for detecting stoppage of the time-keeping operation in the timing means, and a means for maintaining a condition in which the discharge path is shut off by the agency of the charge/discharge control means by nullifying either a voltage measuring operation or measurement results of the voltage measurement means until the stoppage of the time-keeping operation in the timing means is detected by the timing stoppage detection means, after shutting off all discharge paths of the storage means when the voltage between the terminals of the storage means measured by the voltage measurement means falls below a predetermined value, wherein the predetermined value is greater than zero volts.

3. An electronic timepiece according to claim 2, wherein the electronic timepiece includes a means for controlling such that the electric energy generated by the electric power generator is preferentially delivered to the timing means when the amount of the actual capacity that remains in the storage means is less than the predetermined amount and the electric energy generated by the electric power generator is at a predetermined amount or more.

4. An electronic timepiece according to claim 2, wherein the electronic timepiece includes a means for controlling such that the electric energy generated by the electric power generator is delivered to the timing means and the storage means when the amount of the actual capacity that remains in the storage means is less than the predetermined amount and the electric energy generated by the electric power generator is at a predetermined amount or more.

* * * * *